United States Patent [19]

White

[11] 4,220,261

[45] Sep. 2, 1980

[54] DISPENSING CONTAINER ASSEMBLY

[76] Inventor: Douglas J. White, 173 Hillside Ave., Nutley, N.J. 07110

[21] Appl. No.: 899,105

[22] Filed: Apr. 19, 1978

Related U.S. Application Data

[63] Continuation-in-part of Ser. No. 667,331, Mar. 16, 1976.

[51] Int. Cl.[2] ..... B67D 5/52

[52] U.S. Cl. ..... 222/135; 222/153; 222/320

[58] Field of Search ..... 222/319, 320, 135, 136, 222/405, 153, 328; 128/220, 218, 272.1; 215/2

[56] References Cited

U.S. PATENT DOCUMENTS

| | | | |
|---|---|---|---|
| 2,001,819 | 5/1935 | Eue et al. | 222/162 X |
| 2,642,911 | 6/1953 | De Shazor | 215/2 X |
| 3,208,645 | 9/1965 | Rayner | 222/319 |
| 4,029,236 | 6/1977 | Carson | 222/320 X |
| 4,050,612 | 9/1977 | Stone | 222/135 |

*Primary Examiner*—Robert J. Spar
*Assistant Examiner*—Frederick R. Handren
*Attorney, Agent, or Firm*—Lowe, King, Price & Becker

[57] ABSTRACT

A container for fluid products having telescoping parts and operable by outside manual pressure is provided. The container assembly includes a base cup, a plunger cup telescopingly received in the base cup and relatively slidable therein, a nozzle in direct communication with each of the cups, and a pair of slidable pistons, one located in the base cup and relatively fixed with respect to the plunger cup and the other located in the plunger cup relatively fixed with respect to the base cup, for forcing product from the cups to the nozzle upon telescoping movement of the cups together. An air intake is provided to admit air from the surrounding atmosphere between the cups into an interior space adajcent to the slidable pistons to avoid a vacuum in the container and prevent seepage of the products from the cups. A set of locking threads is formed on each of the cups for locking the cups in an extended relationship to prevent undesired telescoping movement in the filling and handling of the container. When disengaged, the threads slidably engage the side walls of the cups to stabilize the telescoping movement of the cups. A telescoping transfer tube assembly is provided to supply product from the base cup directly to the nozzle and to further stabilize the telescoping movement of the cups.

20 Claims, 4 Drawing Figures

26
16
28
29
24
27
25
32
22
62
36
38
40
60
47
48
50
18
20
34
72
12
14
70
70
46
45
42

DISPENSING CONTAINER ASSEMBLY

CROSS REFERENCE TO RELATED APPLICATION

This application is a continuation-in-part of my copending U.S. application Ser. No. 667,331, filed Mar. 16, 1976 and entitled "Dispensing Container and Process of Filling and Assembling".

FIELD OF THE INVENTION

The present invention relates to dispensing containers, and more particularly to an improved container having telescoping cups for dispensing the same or codispensing different products.

BACKGROUND OF THE INVENTION

In marketing in today's world, there is a need for new consumer products to be attractively packaged in new and better containers. This is especially true in the cosmetic and related industries, where a company seeking to compete for a share of even a very narrow market usually finds it is facing at least two or three well established similar products. Although the exact degree will vary, recognized marketing experts do not vary in opinion that an improved package is most important to new product success under these circumstances.

For a company having many and varied consumer fluid products in the above-identified field, it is felt that some of the most important criteria for an improved container that would provide new product success, as well as a sale impetus to selected ones of established products are: (1) a self-dispensing container allowing precise control; (2) a container attractive and novel, but inexpensive to manufacture; (3) a container adaptable to a wide range of products from thin to highly viscous liquids to even granular powders; (4) a container requiring no internal propellants that may pollute the atmosphere; (5) a container easily operated by mild manual pressure requiring use of only one hand, and (6) a container easily filled, assembly and sanitary sealed on a production line with relatively few modifications required on existing machines.

In the past, of course, attempts have been made by companies and individuals alike to provide such a dispenser. But, insofar as we are aware, the attempts have fallen short on these desirable features.

The collapsible tube dispenser and the plastic squeeze bottle are two examples of old and well known containers that meet some of the prerequisites, but not nearly all. Other containers, such as shown in the Elle et at U.S. Pat. No. 2,001,819, have made attempts at reaching the objectives, but have failed to achieve one or more of the above-identified desirable objectives.

Contrary to the earlier attempts made at improving fluid dispensing containers of this type, I set out with the premise that it might be important to provide certain basic conceptual mechanical changes. Between the old collapsible tube, and the tested but unsuccessful telescoping container, I decided that the latter had the best, indeed what I thought was exceptional potential, mainly because it would at least be new and different to the consumer. But, in its stripped form, I had found from firsthand experience that it did not measure up to five of the six more important criteria that the market was asking for, as outlined above.

I then discovered the basic conceptual structural changes required for success, along with other important features and improvements, as disclosed and claimed in my earlier U.S. patent application Ser. No. 667,331 mentioned above.

My earlier invention broadly contemplated the combination of telescoping base and plunger cups incorporating slidable piston means to dispense products from the cups via separate fluid paths through a dispensing nozzle. It also contemplated the provision of locking means to positively lock the cups together and prevent undesired telescoping movement during filling and subsequent handling of the container.

Moreover, upon further developmental work on my invention, I have discovered additional structural features which significantly improve my earlier dispensing container and overcome the critical drawbacks of other prior art proposals. The following concepts constitute important features and improvements of my new dispensing container structure.

Air intake between the telescoping cups of the dispensing container is important, particularly with respect to a relatively large size container. If air is not allowed to enter into the dispensing container, a vacuum is formed as the cups are telescoped together, which tends to draw product from the internal chambers of the cups into the interior spaces between the cups and the pistons. Any product which seeps into these interior spaces cannot be dispensed from the container.

Direct communication between both of the reservoirs and the dispensing nozzle is also important. This combination feature provides more precise control of the dispensing function of fluids over the complete spectrum of viscosities and allows use of the container for dispensing two different products, even with widely varying viscosities, without modification. Moreover, to permit satisfactory co-dispensing of products, it is essential to provide a dispensing container wherein the products have no chance to mix other than outside the container.

A telescoping transfer tube assembly provides the desired direct communication between the telescoping cups and nozzle via separate fluid paths to avoid internal mixing of the products in the container. The telescoping transfer tube arrangement also contributes to the stability of the container.

A conveniently removable transfer tube arrangement allows the dispensing container to be readily adapted for either co-dispensing of different products or dispensing of the same product from its telescoping cups. This flexibility allows the dispensing container to initially contain two different products which are subsequently mixed prior to dispensing of the products.

A locking arrangement which positively locks the cups in an extended relationship allows the container to experience normal handling and shipping prior to use, without the fear of spillage or premature dispensing of the product. This feature contributes as well to accurate positioning of the container parts during assembly to assure complete filling.

A sealing system gives the container competitive shelf life for the products packaged and, coupled with the locking arrangement, serves to meet the standard consumer safety code requirements.

A structural arrangement of components which stabilizes the telescoping cups achieves smooth telescoping action and facilitates use of the dispensing container.

A stand-up or hold in the hand structure is easy to operate for the consumer using only mild pressure and only one hand.

OBJECTIVES OF THE INVENTION

Thus, it is one object of the present invention to provide a dispensing container avoiding the shortcomings of the prior art and having the attributes discussed above.

It is a more specific objective of the present invention to provide a dispenser of the type described that is inexpensive to manufacture and easily assembled and filled.

It is another object of the present invention to provide a telescoping dispenser operable by outside manual pressure which admits air from the surrounding atmosphere between the telescoping parts to avoid product seepage and ensure complete dispensing of all product from the dispenser.

It is another object of the present invention to provide a dispensing container assembly which allows co-dispensing of different products or simultaneous dispensing of a single product and wherein products across the full spectrum of viscosities can be handled separately or together.

It is a further object of the present invention to provide a telescoping container which allows different products to be separately stored and conveniently mixed within the container prior to dispensing.

It is a further object of the present invention to provide a telescoping container with an improved transfer tube arrangement which provides no chance for mixture of different products other than outside of the container.

It is still another object of the present invention to provide a telescoping container having an improved locking arrangement to positively lock the telescoping parts against movement to facilitate handling and filling of the container and to prevent accidental spillage of product.

It is a still further object of the present invention to achieve a telescoping dispensing container which incorporates stabilizing structural features to ensure smooth and easy telescoping action.

Still other objects and advantages of the present invention will become readily apparent to those skilled in this art from the following detailed description, wherein I have shown and described only the preferred embodiments of the present invention, simply by way of illustration of the best modes contemplated by me of carrying out the invention. As will be realized, the invention is capable of other and different embodiments, and its several details are capable of modification in various obvious respects, all without departing from the invention. Accordingly, the drawings and description are to be regarded as illustrative in nature, and not as restrictive.

BRIEF DESCRIPTION OF THE INVENTION

The container assembly has a base cup, and a plunger cup telescopingly positioned in the open top thereof. The base cup is adapted to rest on a table or other convenient surface while product is dispensed by applying a force requiring only mild pressure to the top of the plunger cup. The product is dispensed through a nozzle at the top of the plunger cup into the hand of the user.

The container is designed so that by applying the pressure with the thumb, the product may be dispensed across the fingers of the user. This makes the container have a high degree of utility, especially if the product is to be applied to the body; namely for example, medicinal body creams, hand lotions, shampoos and hair conditioners. In the case of using baby products, this is very important, since the mother can keep one hand on the child while dispensing the product with the other without even picking up the container.

Alternatively, utilizing both hands, pressure may be applied to the top with the fingers of one hand while the product flows onto the fingers of the other hand. The container can be either resting on a suitable surface, or in the case of smaller containers manufactured in accordance with the present invention, the container can be both held in one hand and the pressure applied with either the thumb or index finger of the same hand. Of course, the outlet orifice of the nozzle can also be directed to apply the product directly to any other object, as desired.

Preferably, the two cups are dimensioned to provide a loose, slidable fit at the sliding interface to allow air intake to occur as the cups are telescoped together. The air intake arrangement avoids the creation of a vacuum within the container and prevents undesired seepage of product from the base and plunger cups.

The feed pressure in the plunger cup chamber is provided through a piston located inside this cup which is fixed in relationship to the base cup so that it slides relatively along the inside wall as the plunger cup is telescoped into the base cup. Similarly, the feed pressure in the base cup is provided through another piston located in the base cup and fixed in relationship to the plunger cup so that it slides relatively along the inside wall of the base cup as the cups are telescoped together. As the two pistons move apart, air is admitted into an interior space therebetween to prevent undesired seepage of the product from the plunger and base cups into this space. O-rings may be provided on each piston to provide seals between the pistons and the side walls of the plunger and base cups.

Preferably, locking threads may be formed on the plunger and base cups for locking the cups in an extended relationship to prevent undesired telescoping movement whereby the container assembly may be handled prior to use without accidental spillage of the product from the cups. For example, a set of external threads may be formed at the bottom of the plunger cup for threadably engaging a set of internal threads formed at the top of the base cup when the plunger cup is extended relative to the base cup. In addition, a top portion of the internal threads on the base cup may be narrowed to prevent the cups from being completely unthreaded and to provide a positive lock between the cups. When disengaged, the threads provide an air intake to admit air from the surrounding atmosphere between the side walls of the base and plunger cups into the interior space between the slidable pistons. In addition, the peaks of the external and internal threads slidably engage the side walls of the base cup and plunger cup, respectively, to stabilize the cups during relative telescoping movement.

In the preferred embodiment, the nozzle includes a first dispensing passage directly communicating with the plunger cup and a second dispensing passage for receiving product from the base cup. The dispensing passages provide separate paths for the products in the respective cups and terminate at adjacent positions on the nozzle to mix the dispensed products externally of the container. Thus, there is no chance for undesirable mixing of the products within the dispensing container.

The invention also contemplates an improved transfer tube arrangement to provide direct communication between the base cup and the dispensing nozzle. Preferably, a first tube extends from the nozzle through the plunger cup and includes a first end connected to one of the dispensing passages in the nozzle and a second end telescopingly received in a second tube which is mounted in the base cup and provided with one or more inlets to receive products from the base cup. The transfer tube combination provides direct communication between the base cup and one of the dispensing passages while the other dispensing passage is in direct communication with the plunger cup. Since the two dispensing passages are supplied with product via separate fluid paths, there is no chance for mixing of products within the container.

In the preferred embodiment, the plunger cup includes a hollow neck portion projecting upwardly and providing direct communication with the interior of the plunger cup. The nozzle comprises a cap element having an enlarged opening formed therein for receiving the neck with its first and second dispensing passages extending via separate paths from the enlarged opening. The first tube is adapted for insertion into the cap element to separate its enlarged opening into a first path providing direct communication between the plunger cup and the first dispensing passage and the second fluid path providing direct communication between the base cup and the second dispensing passage. The second tube includes one or more inlet holes at its lower end to admit product from the base cup into the transfer tubes. Preferably, locking means is provided on the neck portion to secure the cap element to the plunger cup.

The telescoping transfer tube arrangement also serves to stabilize the plunger and transfer cups as the cups are telescoped together. The stabilizing influence of the telescoping transfer tube arrangement supplements the stabilization provided by the sliding action of the internal and external threads on the base and plunger cups, respectively, to insure smooth and steady telescoping action.

In the preferred embodiment, a separate cover element is provided at the bottom of the base cup to allow the plunger cup to be inserted through the bottom of the base cup in assembly of the dispensing container. In addition, the bottom cover element engages the lower end of the second tube to hold it firmly in place and further stabilize the dispensing container assembly.

Another significant feature of the improved dispensing container is the flexibility of operation achieved by allowing the option of removal of the transfer tube. This option permits two different products to be stored separately in the plunger and base cups prior to dispensing. If it is desired to mix the products internally within the container, the cap element may be temporarily unseated to allow removal of the transfer tube. When the cap element is replaced, the products can then be mixed and dispensed together from inside the container. This option allows products such as shampoo and hair conditioner to be stored in the dispensing container and kept separate until the desired time of use.

DETAILED DESCRIPTION OF THE PREFERRED EMBODIMENT

Figure 1:
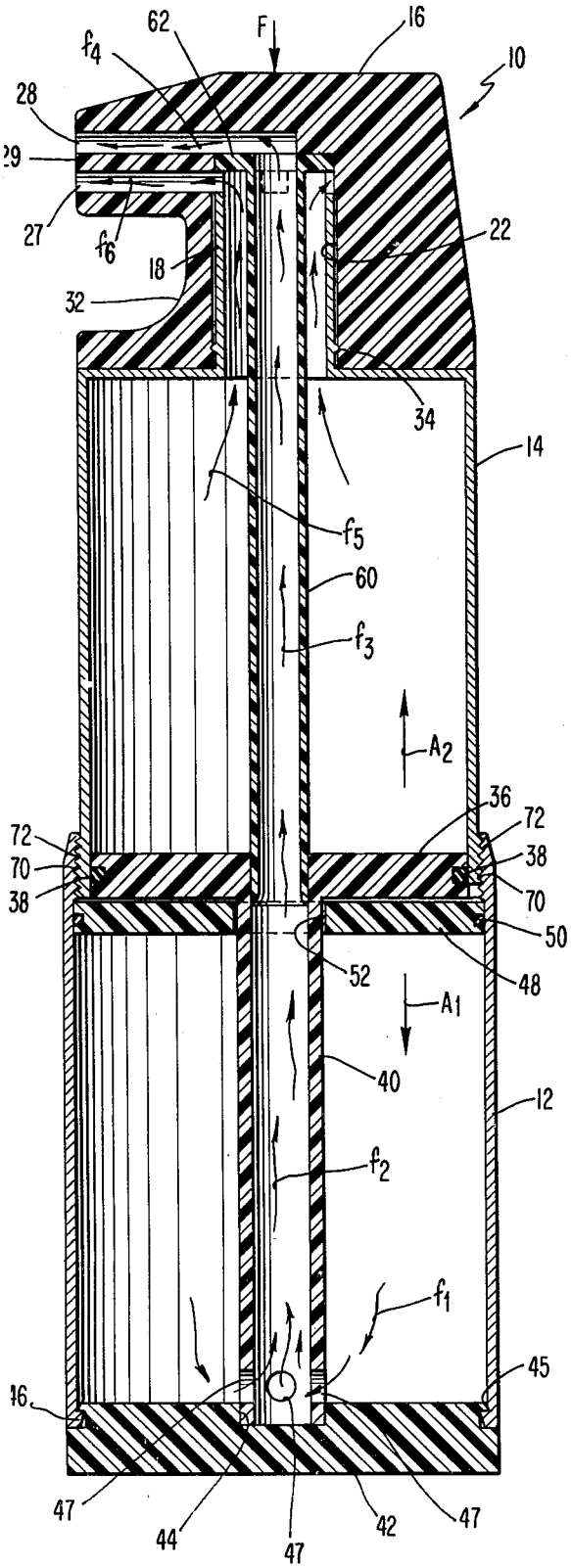
FIG. 1 is a vertical section of the container assembly showing its plunger and base cups held in an extended relationship by locking threads formed on the cups.

Referring to FIG. 1, a container assembly 10 constructed in accordance with the principles of the present invention includes a base cup 12, a plunger cup 14 telescopingly received in the base cup and relatively slidable therein along a peripheral interface between the cups, and a nozzle or cap element 16. Preferably, base cup 12 and plunger 14 are generally cylindrical in configuration and slidably engage each other substantially around their periphery.

Figure 4:
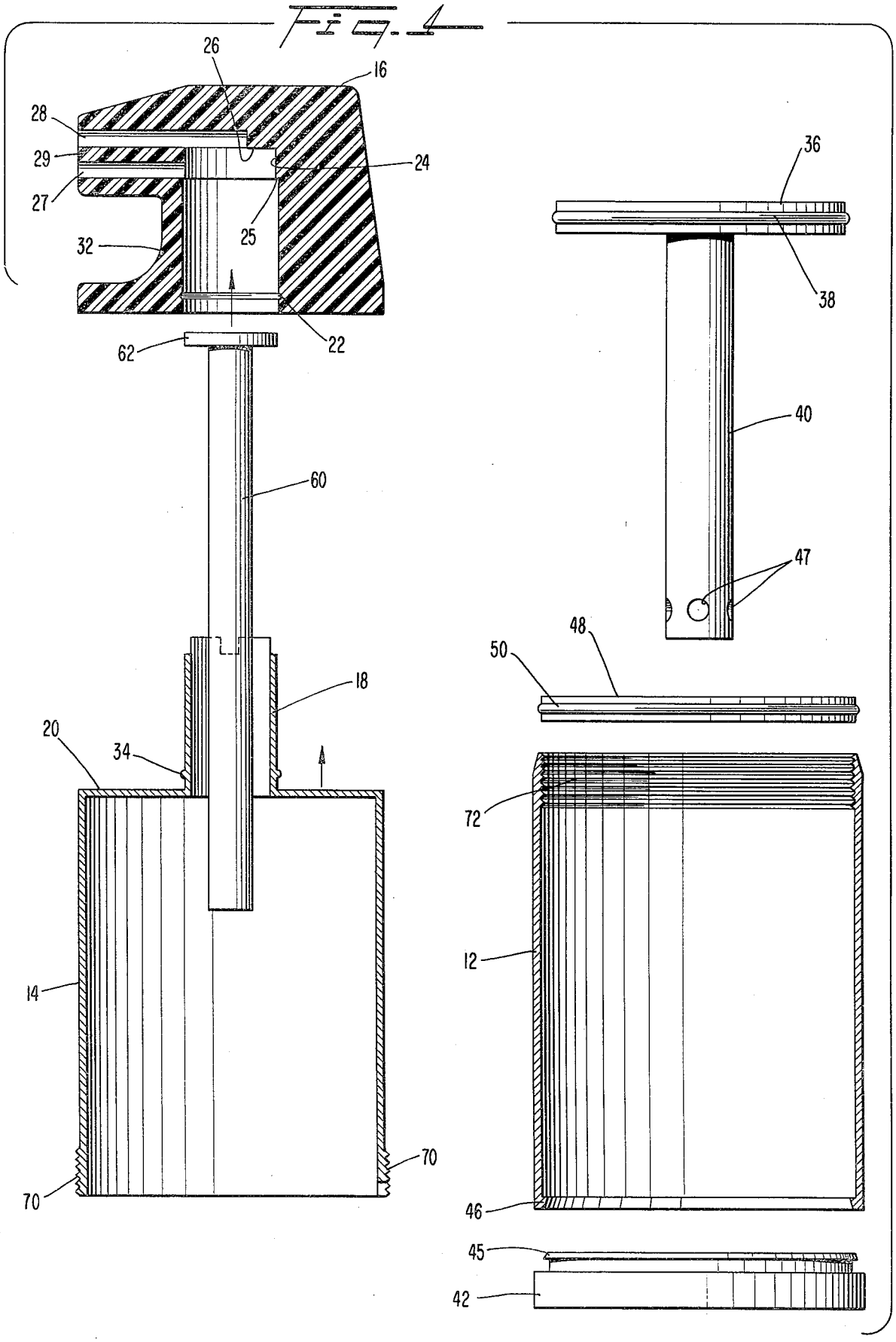
FIG. 4 is an exploded view, partially in section, of the various components of the dispensing container.

As shown in FIGS. 1 and 4, plunger cup 14 includes a hollow, cylindrical neck portion 18 projecting upwardly from a top wall 20 and providing direct communication with the interior of the plunger cup. Nozzle 16 includes an enlarged cylindrical opening 22 extending axially upward from its bottom surface for receiving neck portion 18 of the plunger cup. Enlarged cylindrical opening 22 terminates in a reduced diameter portion 24 to provide an annular shoulder 25 within the opening. Reduced diameter portion 24 terminates at a seat 26 and communicates directly with a first dispensing passage 27 and a second dispensing passage 28 which extend in a radially outward direction therefrom. The dispensing passages are separated by a partition 29.

Preferably, dispensing passages 27 and 28 terminate at adjacent positions on a common exterior surface of the nozzle to mix dispensed products externally of the container. First dispensing passage 27 laterally intersects reduced diameter portion 24 of the enlarged opening in nozzle 16. Second dispensing passage 28 intersects with the top of reduced diameter portion 24 of the opening and extends slightly beyond the center axis of nozzle 16 and its enlarged cylindrical opening 22.

Figure 3:
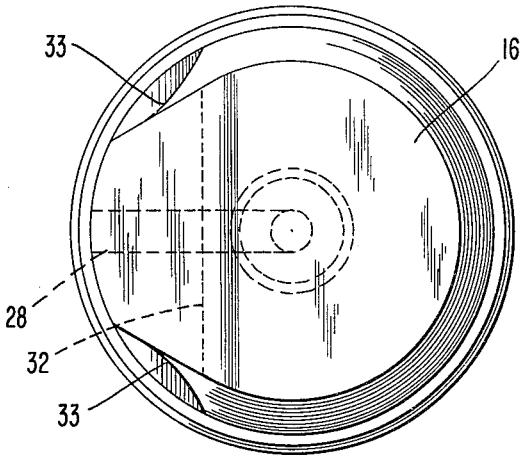
FIG. 3 is a top view of the dispensing container assembly showing its nozzle or cap element.

Nozzle 16 includes an indentation 32 (FIGS. 1 and 4) beneath the dispensing passages and a pair of cutaway areas 33 (FIG. 3) to enable a user to conveniently orient the dispensing passages in a desired direction. A peripheral rib 34 is formed on the exterior of neck portion 18, slightly above top wall 20 of plunger cup 14, to provide a snap-on locking device to secure nozzle or cap element 16 to the plunger cup.

An upper piston 36 is slidably received in the open bottom end of plunger cup 14. An O-ring 38 is mounted within a suitable peripheral groove formed at the edge of piston 36 to provide a seal between the piston and the inner side wall of the plunger cup. Piston 36 is integrally formed at the top of a hollow support tube 40 which extends axially through base cup 12. The bottom of hollow support tube 40 is firmly held in place by a circular cover element 42 received in the lower end of base cup 12 and provided with a circular indentation 44 to receive the support tube. A snap-on locking arrangement (not shown) may be provided to positively lock support tube 40 and cover element 42 together. The cover element also includes a snap-on locking flange 45 for engaging an annular ledge 46 on base cup 12. A plurality of inlet holes 47 is provided adjacent to the bottom of support tube 40 to admit product from the base cup into the support tube.

A lower piston is slidably received in base cup 12. An O-ring 50 is mounted in a peripheral groove formed at the edge of piston 48 to provide a seal between the piston and the inner side wall of base cup 12. Piston 48 includes a circular opening 52 at its center to slidably receive support tube 40 which acts as a guide for the piston.

Transfer Tube Assembly

A transfer tube 60 extends axially through plunger cup 14 to provide direct communication between base cup 12 and dispensing passage 30. The lower end of transfer tube 60 is telescopingly received in hollow support tube 40. The upper end of transfer tube 60 includes a cylindrical flange 62 which, upon insertion into nozzle 16, abuts seat 26, is locked in position in said nozzle means by the upper edge of said neck portion 18 (see FIG. 1), and aligns with partition 29 which separates dispensing passages 27 and 28. The annular space between transfer tube 60 and neck portion 18 defines a first fluid path which provides direct communication between plunger cup 14 and dispensing passage 27. In addition, the hollow interior of support tube 40 and transfer tube 60 define a second fluid path which provides direct communication between base cup 12 and dispensing passage 28. Transfer tube 60 is suitably dimensioned to provide a seal with the hollow interior of support tube 40 to prevent leakage of product from the transfer tube into plunger cup 14. Since base cup 12 and plunger cup 14 communicate directly with the dispensing passages via separate fluid paths, there is no chance for undesired mixing of the products in the cups other than outside of the dispensing container.

Locking Threads

A preferred embodiment of the dispensing container includes locking thread means formed on the plunger and base cups for locking the cups in an extended relationship to prevent telescoping movement and allow the container to be handled prior to use without accidental spillage of the product from the cups. As shown in FIG. 4, a set of external threads 70 is formed at the bottom of plunger cup 14 for threadably engaging a set of internal threads 72 formed at the top of base cup 12. When the plunger cup is extended relative to the base cup, as shown in FIG. 1, the threads may be engaged by suitably rotating the cups relative to each other to lock the cups together. Preferably, a top portion of the set of internal threads 72 is narrowed to provide a positive locking action when the cups are threaded together. This locking arrangement firmly holds the cups in the extended relationship to allow the cups to be completely filled with product in the initial assembly of the dispensing container. Further, the locking of the cups facilitates the storage and shipment of the dispensing pensing container without accidental spillage or leakage of the product.

Figure 2:
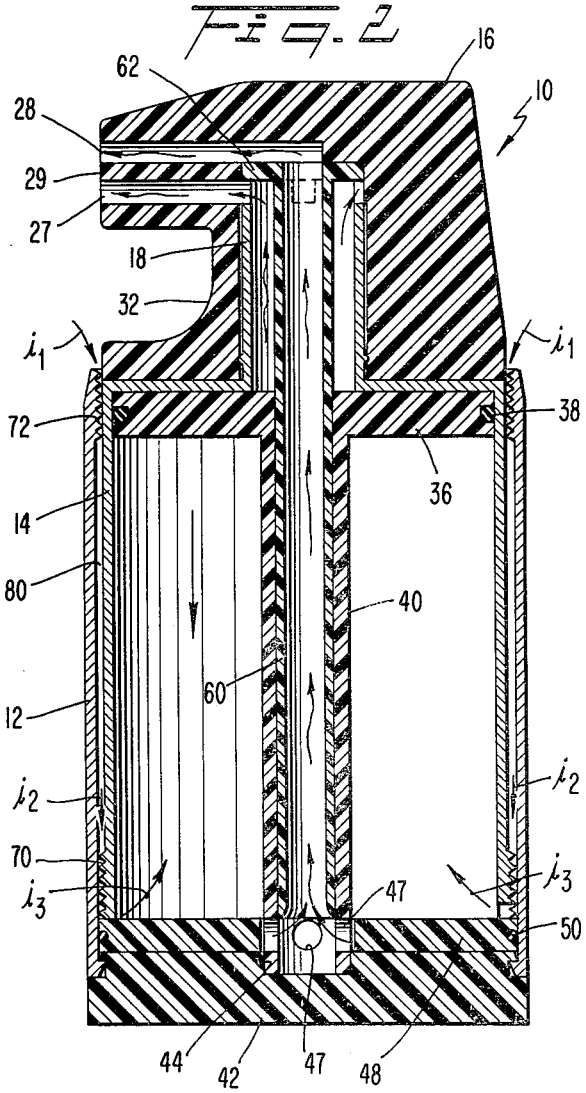
FIG. 2 is a vertical section of the dispensing container assembly with the locking threads disengaged and the plunger cup completely telescoped into the base cup.

When the locking threads are disengaged, as shown in FIG. 2, the peaks of internal threads 72 slidably engage the outer side wall of plunger wall 14. Similarly, the peaks of external threads 70 slidably engage the inner side wall of base cup 12. This sliding engagement serves to stabilize the telescoping movement of the base and plunger cups and keep the cups in axial alignment.

Operation of Dispensing Container

When it is desired to operate the dispensing container, the locking threads are initially disengaged by rotating base cup 12 and plunger cup 14 until the threads are disengaged. When an outside force is applied by manual pressure, as represented by arrow F to the top of nozzle or cap element 16, plunger cup 14 starts to telescope into base cup 12 and to push piston 48 downward as indicated by movement arrow $A_1$ (FIG. 1). Upper piston 36 remains stationary with respect to base cup 12, so that in terms of relative movement, piston 36 moves upward relative to plunger cup 14, as indicated by movement arrow $A_2$.

As a consequence of this compound movement, the product in the chamber of base cup 12 is forced through radial inlet holes 47 (as indicated by flow arrows $f_1$), upward through support tube 40 and transfer tube 60 (indicated by flow arrows $f_2$ and $f_3$), and outwardly through dispensing passage 28 (as indicated by flow arrows $f_4$).

Simultaneously, the relative movement illustrated by arrow $A_2$ causes the product in the chamber of plunger cup 14 to flow upward through its neck portion 18 (as indicated by flow arrows $f_5$) and outwardly through dispensing passage 27 (as indicated by flow arrows $f_6$). The products dispensed from passages 27 and 28 are mixed together in the area adjacent to the dispensing passage outlets. Thus, when two different products are stored in base cup 12 and plunger cup 14, no mixing of the products is possible except outside of the container. Of course, it will be understood that, if desired, the same products could be dispensed from both cups of the container.

As explained above, the sliding engagement of threads 70 and 72 with the base and plunger cups acts to stabilize the telescoping movement of the cups. In addition, the telescoping movement of transfer tube 60 into support tube 40 also serves to stabilize the container.

Removable Transfer Tube Option

The dispensing container of the present invention may be also advantageously employed to store different products in its base and plunger cups which are desirably mixed prior to the actual dispensing from the container. For example, products such as shampoo and hair conditioner can be located in the container and kept separate until time of use. When it is desired to dispense these products, nozzle or cap element 16 is temporarily removed and transfer tube 16 is completely withdrawn from plunger cup 14. Then, after the nozzle is replaced on the plunger cup, the user can mix the two products together inside the container and then dispense the mixed products by application of suitable pressure.

Air Intake Arrangement

Referring to FIG. 2, the base and plunger cups may be suitably dimensioned to provide a relatively loose fit between the telescoping parts. For example, the internal diameter of base cup 12 may slightly exceed the external diameter of plunger cup 14 to provide a narrow annular gap 80 between the side walls of the cups. The purpose of this gap between the telescoping portions of said base and plunger cups is to allow air from the surrounding atmosphere to enter into the internal space between pistons 36 and 48 which gradually enlarges as the cups are telescoped together. The air intake into annular space 80 occurs along the sliding interface between the peaks of internal threads 72 at the top of the base cup and the outer side wall of plunger cup 14, as indicated by intake arrows $i_1$ (FIG. 2). The air admitted into annular gap 80 travels downwardly between the telescoping portions of the cups and between externally threaded portion 70 of plunger cup 14 and the inner side wall of base cup 12 (indicated by arrow $i_2$). From this point, the air passes into the internal space between the lower end of plunger cup 14 (piston 48) and piston 36 through a notch formed in the lower threaded section (indicated by arrow $i_3$). This air intake arrangement avoids the formation of a vacuum in the space between pistons 36 and 48 and prevents seepage of product from base cup 12 or plunger cup 14 into this space. Accordingly, all of the product packaged in this dispensing container is dispensed through the nozzle and little or no product is wasted.

Assembly and Filling of Dispensing Container

Referring to FIG. 4, in the assembly of the dispensing container, plunger cup 14 is initially inserted upward through the open bottom end of base cup 12. The base and plunger cups are threaded and locked together by rotating the cups relative to each other. Next, the upper end of transfer tube 60 is inserted into enlarged central opening 22 of nozzle 16 to bring its collar or flange 62 into seating engagement with seat 26 and in alignment with partition 29. Transfer tube 60 is then inserted through neck portion 18 of the plunger cup and nozzle 16 is snapped into place over ridge 34.

The partially assembled container is then turned upside down and plunger cup 14 is filled with product. If necessary, dispensing passage 27 may be covered or blocked to prevent spillage of product. However, in the case of products such as heavy creams, it is contemplated that no covering or blocking of the passage will be required.

After plunger cup 14 is filled with product, lower piston 48, with its O-ring 50 already in place, is slid over support tube 40, with O-ring 38 already in place on upper piston 36. Then, with the partially assembled and filled container still upside down, the piston assembly is inserted through the open end of base cup 12 to bring piston 36 and O-ring 38 into sealing engagement with the inner side wall of plunger cup 14. Piston 48 is moved to its uppermost position in base cup 12 until the piston is stopped by internally threaded portion 72 of the base cup or the lower end of plunger cup 14. Next, with the partially assembled container upside down, base cup 12 is filled with product. Then, bottom cover element 42 is snapped into place with the bottom end of support tube 40 received in its central indentation 44. The completed container is then turned over and ready for shipment or use.

All of the container parts are made of a suitable plastic, such as a high density polyethylene, polypropylene or any other plastic that exhibits the requisite strength characteristics and is inert to the product being packaged. Known injection molding techniques have been found to be suitable for forming the parts. However, it should be understood that other suitable materials, such as metals or the like that may be required by other products and other manufacturing techniques, such as casting and/or machining, can be utilized in accordance with the basic principles of the present invention.

The package is aesthetically attractive and can be provided with any decorative printing, such as by silk screening, directly on the outer wall surface (such decorative printing not shown). In addition to cylindrical, other desired shapes, such as rectangular or oval, may be employed to provide additional attractiveness and distinctiveness to the container to enhance customer identification of the product being packaged.

In summary, a dispensing container has been provided that will offer manufacturers an exceptionally advantageous dispenser. No force, other than outside manual pressure, is required for dispensing; the container is inexpensive, aesthetically pleasing, tamperproof and safe to be around children; and easy and economical to fill and assemble. The container structure advantageously provides for air intake between its telescoping cups to avoid creations of an internal vacuum and to insure complete dispensing of all products from the container. Its locking thread arrangement provides for positive locking of the telescoping cups together to insure maximum filling of the container and to prevent undesired leakage of products from the container prior to its actual usage. Its telescoping transfer tube arrangement advantageously provides separate fluid paths to enable co-dispensing of different products with no chance for mixture of the products other than outside of the container. The telescoping transfer tube also provides stability in the telescoping action of the cups to supplement the stabilizing influence of the locking threads which, when unthreaded, slidably engage the side walls of the cups.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A dispensing container assembly for fluid products operable by outside manual pressure, comprising:

a base cup;

a plunger cup telescopingly received in said base cup and relatively slidable therein;

said plunger cup slidably engaging the base cup along a peripheral interface;

nozzle means directly communicating with each of said cups;

slidable piston means in at least one of said cups relatively fixed with respect to said at least one cup whereby the same or different products in said cups may be simultaneously directly dispensed to said nozzle means upon application of outside pressure to said cups;

stabilizing means provided on each of said cups for slidable engagement with the other cup to maintain said cups in axial alignment as said cups are telescoped together; and means for admitting air from the surrounding atmosphere including means for forming a gap between the telescoping portions of said base and plunger cups whereby air enters through said gap and along said interface between said telescoping portions and into an interior space adjacent to said slidable piston means as product is dispensed from said cups.

2. The dispensing container assembly of claim 1, wherein said stabilizing means includes:

a set of locking threads formed on each of said cups for locking said cups in an extended relationship when threadably engaged to prevent telescoping movement, each set of threads slidably engaging the side wall of the other of said cups when unthreaded to maintain said cups in axial alignment.

3. The dispensing container assembly of claim 4, wherein each set of threads permits air flow from the surrounding atmosphere into said interface between said cups and into said interior space adjacent to said slidable piston means.

4. The dispensing container assembly of claim 1, wherein said slidable piston means includes:

a first slidable piston located in said base cup and relatively fixed with respect to said plunger cup for forcing product from said base cup to said nozzle means upon telescoping movement of said cups together;

a second slidable piston located in said plunger cup and relatively fixed with respect to said base cup for forcing product from said plunger cup to said nozzle means upon telescoping movement of said cups together; and said first and second pistons being movable apart as said cups telescope together to provide said interior space for receiving air from the surrounding atmosphere.

5. The dispensing container assembly of claim 4, which includes:

sealing means located between said first slidable piston and said base cup and between said second slidable piston and said plunger cup to prevent leakage and contain the products within said cups.

6. The dispensing container assembly of claim 1, wherein said means for forming a gap for entry of air is provided around substantially the full periphery of said interface between said telescoping cups.

7. A dispensing container assembly for fluid products operable by outside manual pressure, comprising:

a base cup;

a plunger cup telescopingly received in said base cup and relatively slidable therein;

nozzle means directly communicating with each of said cups;

a slidable piston means in at least one of said cups and relatively fixed with respect to said at least one cup whereby the same or different products in said cups may be simultaneously directly dispensed to said nozzle means upon application of outside pressure to said cups; and locking thread means formed on said cups for locking said cups in an extended relationship to prevent telescoping movement whereby the container assembly may be handled prior to use without accidental spillage of product from said cups.

8. The dispensing container assembly of claim 7, wherein said locking thread means comprises:

a set of external threads formed at the bottom of said plunger cup for threadably engaging a set of internal threads formed at the top of said base cup when said plunger cup is extended relative to said base cup.

9. The dispensing container assembly of claim 8, wherein:

a top portion of said set of internal threads is narrowed to provide a positive lock when said set of external threads are threaded therein.

10. The dispensing container assembly of claim 8, wherein:

said external and internal threads when disengaged slidably engage the side walls of said base cup and plunger cup, respectively, to stabilize said cups during relative telescoping movement.

11. The dispensing container assembly of claim 8, wherein:

said external and internal threads when disengaged admit air from the surrounding atmosphere between the side walls of said base and plunger cups into an interior space adjacent to said slidable piston means as product is dispensed from said cups.

12. The dispensing container assembly of claim 11, wherein said slidable piston means includes:

a first slidable piston located in said base cup and relatively fixed with respect to said plunger cup for forcing product from said base cup to said nozzle means upon telescoping movement of said cups together;

a second slidable piston located in said plunger cup and relatively fixed with respect to said base cup for forcing product from said plunger cup to said nozzle means upon telescoping movement of said cups together; and said first and second pistons being movable apart as said cups telescope together to provide said interior space for receiving air from the surrounding atmosphere.

13. The dispensing container assembly of claim 12, which includes:

sealing means located between said first slidable piston and said base cup and between said second slidable piston and said plunger cup to prevent leakage and contain the products within said cups.

14. A dispensing container assembly for fluid products operable by outside manual pressure, comprising:

a base cup;

a plunger cup telescopingly received in said base cup and relatively slidable therein;

nozzle means having a first dispensing passage directly communicating with said plunger cup and a second dispensing passage for receiving product from said base cup;

a readily removable tube extending through said plunger cup and having a first end communicating with said second dispensing passage and a second end communicating with said base cup to receive products from said base cup, means for seating said first end in said nozzle means;

means adjacent said first end for locking said removable tube in position in said nozzle means; and slidable piston means located in at least one of said cups and relatively fixed with respect to said at least cup whereby the same or different products in said cups may be simultaneously directly dispensed to said nozzle means upon application of outside pressure to said cups, said tube being removed when products in said cups are to be mixed prior to being dispensed.

15. The dispensing container assembly of claim 14, wherein:

said dispensing passages terminate at adjacent positions on said nozzle means to mix the dispensed products externally of the container.

16. The dispensing container assembly of claim 14, wherein said slidable piston means includes:

a first slidable piston located in said base cup and relatively fixed with respect to said plunger cup for forcing product from said base cup to said nozzle means upon telescoping movement of said cups together; and a second slidable piston located in said plunger cup and relatively fixed with respect to said base cup for forcing product from said plunger cup to said nozzle means upon telescoping movement of said cups together.

17. The dispensing container assembly of claim 16, which includes:

means for admitting air from the surrounding atmosphere along the sliding peripheral interface between said cups into an interior space located between said first and second slidable pistons.

18. The dispensing container assembly of claim 14, wherein:

said plunger cup includes a hollow neck portion projecting upwardly and providing direct communication with the interior of said plunger cup;

said nozzle means comprises a cap element having an enlarged opening formed therein for receiving said neck portion, said first and second dispensing passages extending via separate paths from said enlarged opening; and said removable tube including a flange adjacent said first end for insertion into said enlarged opening of said cap element forming said seating means, said flange serving to define a first path providing direct communication between said plunger cup and said first dispensing passage and a second fluid path providing direct communication between said base cup and said second dispensing passage.

19. The dispensing container assembly of claim 18, which includes:

cap locking means formed on said neck portion for securing said cap element to said plunger cup; and said flange of said tube being captured between the upper edge of said neck portion and said cap element when said cap element is secured to said plunger cup to form said tube locking means.

20. The dispensing container assembly of claim 14, including:

a locking cover element for closing the bottom of said base cup, said cover element having a flange adapted to engage an inwardly directed annular ledge formed on a lower portion of said base cup to secure said cover element to said base cup.

* * * * *